US010710363B2

(12) United States Patent
Takemoto

(10) Patent No.: US 10,710,363 B2
(45) Date of Patent: Jul. 14, 2020

(54) INKJET PRINTING APPARATUS WITH INK EJECTION TIMING CORRECTING FUNCTION

(71) Applicant: RISO KAGAKU CORPORATION, Tokyo (JP)

(72) Inventor: Kazuhiro Takemoto, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/357,859

(22) Filed: Mar. 19, 2019

(65) Prior Publication Data

US 2019/0299604 A1 Oct. 3, 2019

(30) Foreign Application Priority Data

Mar. 30, 2018 (JP) ..... 2018-068039

(51) Int. Cl.

| | |
|---|---|
| ***B41J 2/045*** | (2006.01) |
| ***B41J 2/21*** | (2006.01) |
| ***B41J 11/00*** | (2006.01) |
| ***B41J 29/38*** | (2006.01) |
| *B41J 29/393* | (2006.01) |

(52) U.S. Cl.

CPC ..... *B41J 2/04573* (2013.01); *B41J 2/04586* (2013.01); *B41J 2/2135* (2013.01); *B41J 11/008* (2013.01); *B41J 29/38* (2013.01); *B41J 2029/3935* (2013.01)

(58) Field of Classification Search

CPC ..... B41J 2/04573; B41J 11/008; B41J 29/38; B41J 2/04586; B41J 2/2135; B41J 2029/3935

See application file for complete search history.

(56) References Cited

U.S. PATENT DOCUMENTS

2009/0290184 A1* 11/2009 Nishida ..... B41J 2/04508 358/1.13

2011/0074860 A1 3/2011 Saettel et al.

(Continued)

FOREIGN PATENT DOCUMENTS

JP 2010-208231 A 9/2010
JP 2017-065063 A 4/2017

OTHER PUBLICATIONS

Jul. 30, 2019 extended European Search Report in corresponding European Application No. 19164018.4.

*Primary Examiner* — Henok D Legesse
(74) *Attorney, Agent, or Firm* — Greenblum & Bernstein, P.L.C.

(57) ABSTRACT

An inkjet printing apparatus includes: a roller configured to rotate in synchronization with the print medium being conveyed; an encoder configured to output a pulse signal depending on a rotation angle of the roller; and a controller. The controller is configured to: perform an off-center information obtaining processing of driving the inkjet head to print a test pattern including dots arranged in a conveyance direction of the print medium and calculating an off-center information of the roller based on positions of the dots in the printed test pattern; and in the printing operation, correct the ejection timing of the ink by the inkjet head determined based on the pulse signal outputted from the encoder, based on the off-center information calculated in the off-center information obtaining processing.

7 Claims, 11 Drawing Sheets

(56) References Cited

U.S. PATENT DOCUMENTS

2011/0205280 A1 8/2011 Koshikawa et al.
2012/0287197 A1* 11/2012 Yasutani ..... B41J 29/38
347/16

* cited by examiner

INKJET PRINTING APPARATUS WITH INK EJECTION TIMING CORRECTING FUNCTION

CROSS REFERENCE TO RELATED APPLICATION

This application is based upon and claims the benefit of priority from the prior Japanese Patent Application No. 2018-068039, filed on Mar. 30, 2018, the entire contents of which are incorporated herein by reference.

BACKGROUND

1. Technical Field

The disclosure relates to an inkjet printing apparatus which performs printing by ejecting inks from inkjet heads to a print medium.

2. Related Art

There is known an inkjet printing apparatus which performs printing on a print medium by ejecting inks from inkjet heads while conveying the print medium.

It is known that such an inkjet printing apparatus controls ejection timings of the inks in the inkjet heads based on an output pulse signal of an encoder installed in a roller configured to rotate in synchronization with the print medium.

In this case, when the roller in which the encoder is installed is off-centered, a conveyance amount of the print medium varies depending on a rotation angle of the roller. Accordingly, when the ink ejection timings are controller based on the output pulse signal of the encoder, "landing position deviation" occurs in which landing positions of the ink deviate from target positions. The ink landing position deviation leads to a decrease in print image quality.

To counter this, Japanese Patent Application Publication No. 2010-208231 discloses the following technique. In an inkjet printing apparatus which controls ink ejection timings based on an output pulse signal of an encoder installed in a roller around which a conveyor belt for conveying a recording medium is wound, the speed of the conveyor belt is measured by using a laser Doppler velocimeter. Then, an off-center component of the roller is calculated from data of this measurement as roller profile data and the ink ejection timings are corrected by using the roller profile data. The ink landing position deviation caused by off-centering of the roller in which the encoder is installed is thus reduced.

SUMMARY

In the technique of Japanese Patent Application Publication No. 2010-208231, when the encoder or the roller in which the encoder is installed is replaced, the speed of the conveyor belt needs to be measured again to obtain the roller profile data. Accordingly, when the encoder or the roller is replaced at the site of the user where the inkjet printing apparatus is installed, a large and high-cost measurement unit such as the laser Doppler velocimeter needs to be brought to the site of the user. Thus, it is not easy to reduce the ink landing position deviation by performing the processing of obtaining the roller profile data.

In a configuration in which the roller and the encoder are unitized, the roller profile data can be obtained during manufacturing of the unit. When the replacement of the roller or the encoder becomes necessary, the unit is replaced and the roller profile data obtained in the manufacturing of the unit is stored in the inkjet printing apparatus. In this way, this configuration can reduce the ink landing position deviation caused by the off-centering of the roller.

However, in this case, even a part which does not have to be replaced is sometimes replaced and is thus wasted. For example, when the roller is the only part which needs to be replaced, the encoder is also replaced because the entire unit is replaced. Thus, the encoder is wasted.

The disclosure is directed to an inkjet printing apparatus which can easily reduce ink landing position deviation while reducing wasting of parts.

An inkjet printing apparatus in accordance with some embodiments includes: an inkjet head configured to print an image on a print medium being conveyed by ejecting an ink to the print medium; a roller configured to rotate in synchronization with the print medium being conveyed; an encoder configured to output a pulse signal depending on a rotation angle of the roller; and a controller configured to control an ejection timing of the ink by the inkjet head in a printing operation, based on the pulse signal outputted from the encoder. The controller is configured to: perform an off-center information obtaining processing of driving the inkjet head to print a test pattern including dots arranged in a conveyance direction of the print medium and calculating an off-center information of the roller based on positions of the dots in the printed test pattern; and in the printing operation, correct the ejection timing of the ink by the inkjet head determined based on the pulse signal outputted from the encoder, based on the off-center information calculated in the off-center information obtaining processing.

According to the aforementioned configuration, it is possible to easily reduce ink landing position deviation while reducing wasting of parts.

DETAILED DESCRIPTION

Figure 1:
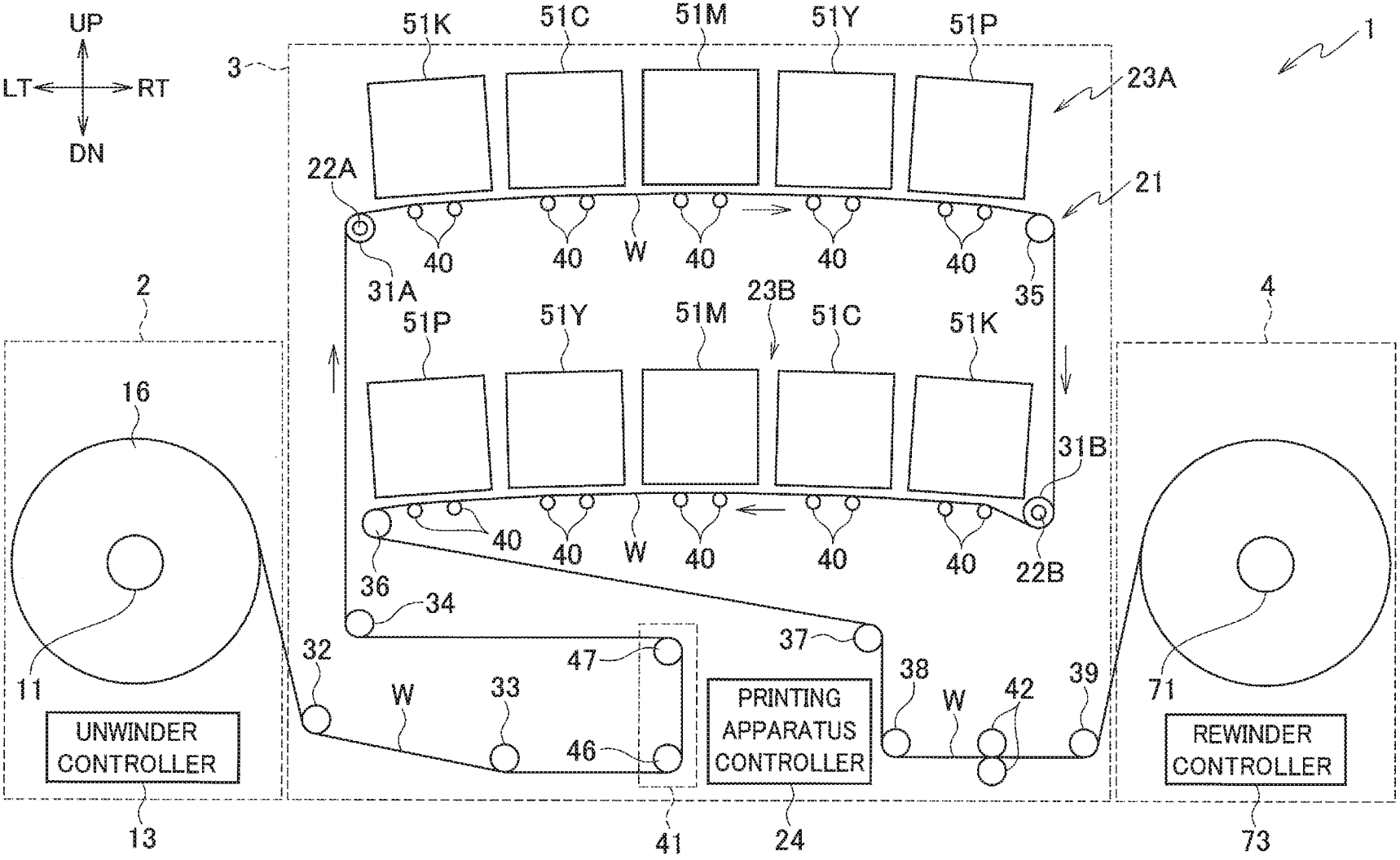
FIG. 1 is a schematic configuration view of a print system including an inkjet printing apparatus according to a first embodiment.

In the following detailed description, for purposes of explanation, numerous specific details are set forth in order to provide a thorough understanding of the disclosed embodiments. It will be apparent, however, that one or more embodiments may be practiced without these specific details.

In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
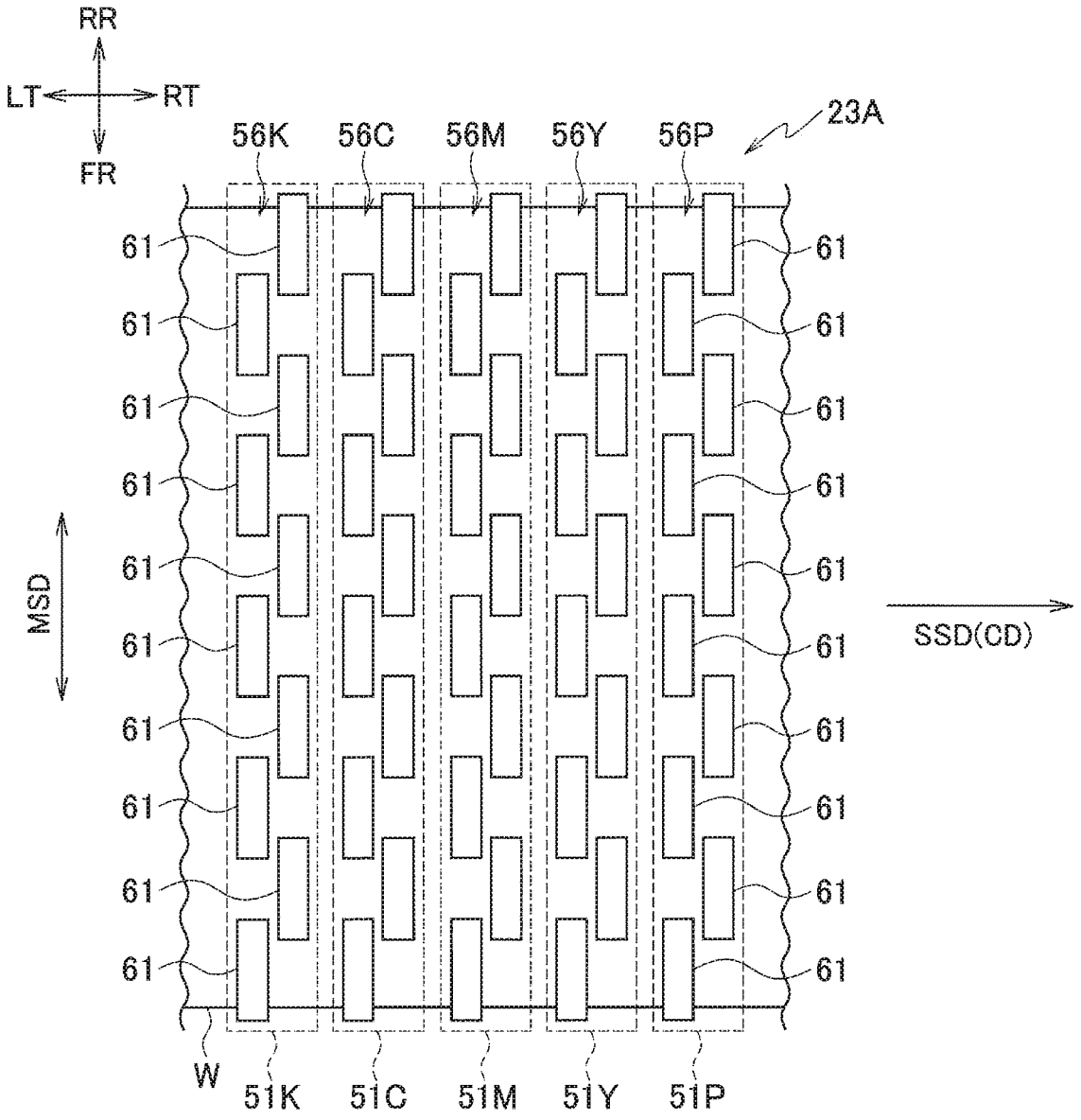
FIG. 2 is a plan view of a printer in an inkjet printing apparatus in the print system illustrated in FIG. 1.
Figure 3:
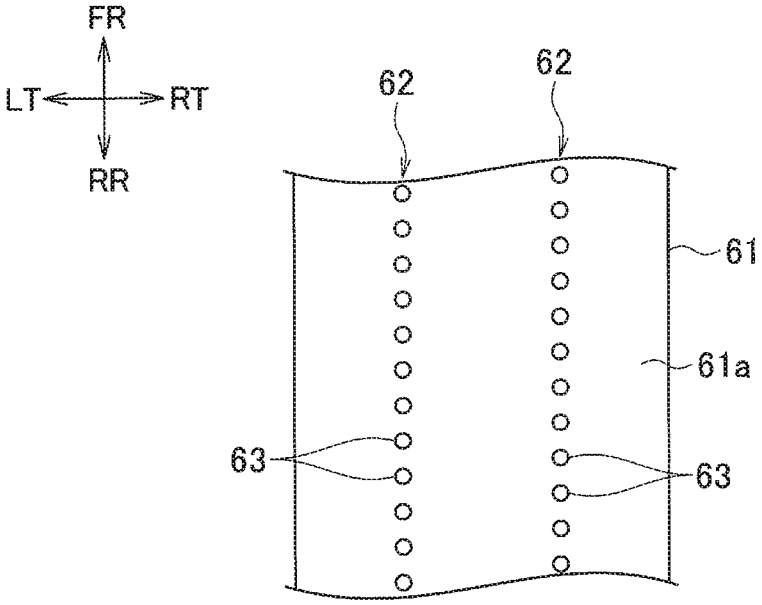
FIG. 3 is a view illustrating a nozzle surface of a head module included in the printer illustrated in FIG. 2.
Figure 4:
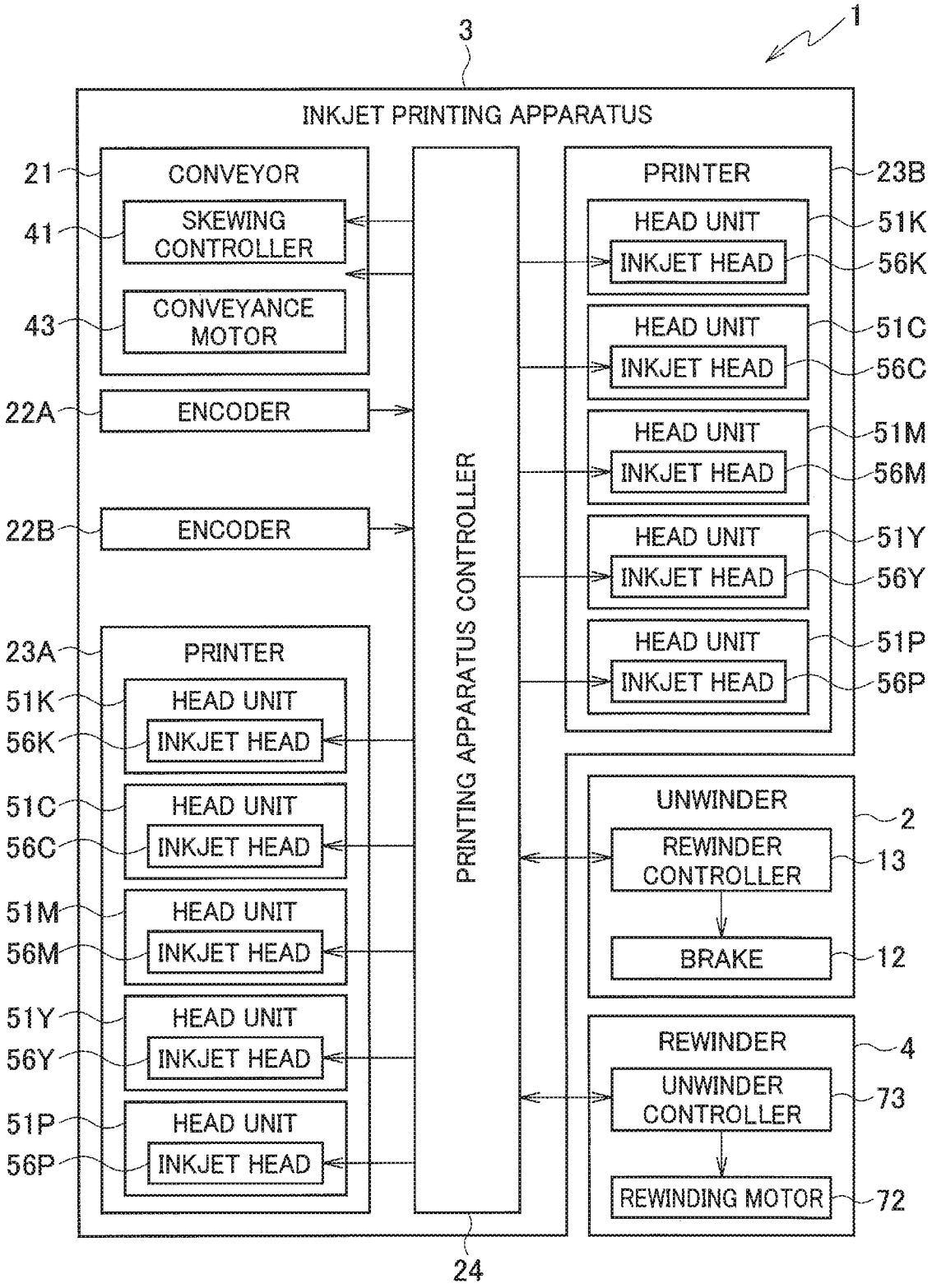
FIG. 4 is a control block diagram of the print system illustrated in FIG. 1.

FIG. 1 is a schematic configuration view of a print system 1 including an inkjet printing apparatus 3 according the first embodiment. FIG. 2 is a plan view of printers 23A, 23B of the inkjet printing apparatus 3 in the print system 1 illustrated in FIG. 1. FIG. 3 is a view illustrating a nozzle surface 61*a* of each of head modules 61 included in the printers 23A, 23B illustrated in FIG. 2. FIG. 4 is a control block diagram of the print system 1 illustrated in FIG. 1. In the following description, a direction orthogonal to the sheet surface of FIG. 1 is referred to as front-rear direction. Moreover, up, down, left, and right in the sheet surface of FIG. 1 are referred to as directions of up, down, left, and right. In FIGS. 1, 3, 6, and 14 (second embodiment), directions of right, left, up, down, front, rear, main scanning direction, and sub-scanning direction (conveyance direction) are denoted by RT, LT, UP, DN, FR, RR, MSD, and SSD (CD), respectively.

As illustrated in FIGS. 1 and 4, the print system 1 according to the first embodiment includes an unwinder 2, the inkjet printing apparatus 3, and a rewinder 4.

The unwinder 2 unwinds a web W being a long print medium made of film, paper, or the like to the inkjet printing apparatus 3. The unwinder 2 includes a web roll support shaft 11, a brake 12, and an unwinder controller 13.

The web roll support shaft 11 rotatably supports a web roll 16. The web roll 16 is the web W wound into a roll.

The brake 12 applies brake to the web roll support shaft 11. Tension is thereby applied to the web W between the web roll 16 and a pair of conveyance rollers 42 of the inkjet printing apparatus 3 to be described later.

The unwinder controller 13 controls the brake 12. The unwinder controller 13 includes a CPU, a memory, a hard disk drive, and the like.

The inkjet printing apparatus 3 prints images on the web W while conveying the web W unwound from the web roll 16. The inkjet printing apparatus 3 includes a conveyor 21, encoders 22A, 22B, the printers 23A, 23B, and a printing apparatus controller (controller) 24. Note that members such as the encoders 22A, 22B may be collectively referred to by omitting the alphabets attached to the reference numeral.

The conveyor 21 conveys the web W unwound from the web roll 16 to the rewinder 4. The conveyor 21 includes encoder rollers 31A, 31B, guide rollers 32 to 39, 20 under-head rollers 40, a skewing controller 41, the pair of conveyance rollers 42, and a conveyance motor 43.

The encoder rollers 31A, 31B, the guide rollers 32 to 39, the under-head rollers 40, the conveyance rollers 42, and skewing control rollers 46, 47 of the skewing controller 41 to be described later form a conveyance route of the web W in the conveyor 21.

The encoder rollers 31A, 31B are rollers which guide the web W near and upstream of the printers 23A, 23B in the conveyance direction of the web W, respectively, and are rollers in which the encoders 22A, 22B are installed, respectively. The encoder rollers 31A, 31B rotate by following (rotate in synchronization with) the web W being conveyed. The encoder rollers 31A, 31B each have an outer diameter different from those of all other rollers which are the guide rollers 32 to 39, the under-head rollers 40, the conveyance rollers 42, and the skewing control rollers 46, 47. Moreover, the encoder rollers 31A, 31B have outer diameters different from each other. It is noted that the encoder rollers 31A, 31B may have the same outer diameter.

The guide rollers 32 to 39 are rollers which guide the web W being conveyed inside the inkjet printing apparatus 3. The guide rollers 32 to 39 rotate by following (rotate in synchronization with) the web W being conveyed.

The guide roller 32 is arranged in a left end portion of a lower portion of the inkjet printing apparatus 3. The guide roller 33 is arranged between the guide roller 32 and the skewing control roller 46 of the skewing controller 41 to be described later. The guide roller 34 is arranged at a position which is slightly above and on the left side of the skewing control roller 47 of the skewing controller 41 to be described later and which is below the encoder roller 31A. The guide roller 35 is arranged near and downstream of the printer 23A, between the encoder rollers 31A, 31B, at substantially the same height as the encoder roller 31A.

The guide roller 36 is arranged near and downstream of the printer 23B, at substantially the same height as the encoder roller 31B. The guide roller 37 is arranged on the lower right side of the guide roller 36. The guide roller 38 is arranged below and slightly on the right side of the guide roller 37. The guide roller 39 is arranged on the right side of the guide roller 38, in a right end portion of the lower portion of the inkjet printing apparatus 3.

The under-head rollers 40 support the web W under head units 51 to be described later in an area between the encoder roller 31A and the guide roller 35 and an area between the encoder roller 31B and the guide roller 36. Ten under-head rollers 40 are arranged in each of the area between the encoder roller 31A and the guide roller 35 and the area between the encoder roller 31B and the guide roller 36. Moreover, two under-head rollers 40 are arranged just below each head unit 51. The under-head rollers 40 rotate by following (rotate in synchronization with) the web W being conveyed.

The skewing controller 41 corrects skewing which is fluctuation in the position of the web W in a width direction (front-rear direction). The skewing controller 41 includes the skewing control rollers 46, 47.

The skewing control rollers 46, 47 are rollers for guiding the web W and correcting the skewing of the web W. The skewing control rollers 46, 47 rotate by following (rotate in synchronization with) the web W being conveyed. The skewing control rollers 46, 47 move the web W in the width direction by being turned by a not-illustrated motor to tilt with respect to the width direction of the web W as viewed in the left-right direction and thereby correct the skewing.

The skewing control roller 46 is arranged on the right side of the guide roller 33. The skewing control roller 47 is arranged above the skewing control roller 46.

The pair of conveyance rollers 42 conveys the web W toward the rewinder 4. The pair of conveyance rollers 42 conveys the web W while nipping it with one conveyance roller 42 which is rotationally driven by the conveyance motor 43 and the other conveyance roller 42 which rotates by following the one conveyance roller 42. Accordingly, it can be said that the pair of conveyance rollers 42 rotates in synchronization with the web W being conveyed. The pair of conveyance rollers 42 is arranged between the guide rollers 38, 39.

The conveyance motor 43 rotationally drives the one conveyance roller 42.

The encoders 22A, 22B are installed in the encoder rollers 31A, 31B, respectively, and output pulse signals (A-phase signal, B-phase signal) depending on rotation angles of the encoder rollers 31A, 31B, every time the encoder rollers 31A, 31B turn by a predetermined angle. Moreover, the encoders 22A, 22B each output a Z-phase signal which is a reference signal indicating one rotation of a corresponding one of the encoder rollers 31A, 31B.

The printer 23A prints images on a front surface of the web W. The printer 23A is arranged near and above the web W between the encoder roller 31A and the guide roller 35. The printer 23A includes head units 51K, 51C, 51M, 51Y, 51P.

The head units 51K, 51C, 51M, 51Y, 51P include inkjet heads 56K, 56C, 56M, 56Y, 56P, respectively. The head units 51K, 51C, 51M, 51Y, 51P are aligned in the sub-scanning direction (left-right direction) which is the conveyance direction of the web W.

The inkjet heads 56K, 56C, 56M, 56Y, 56P print images by ejecting inks of black (K), cyan (C), magenta (M), yellow (Y), and an extra ink color to the web W, respectively. Red, light cyan, or the like is used as the extra ink color. The inkjet heads 56K, 56C, 56M, 56Y, 56P have the same configuration except for the point that the inks to be ejected are different.

Each inkjet head 56 has ten head modules 61. The ten head modules 61 are arranged in zig-zag. Specifically, in each inkjet head 56, the ten head modules 61 arranged in the front-rear direction (main scanning direction) are arranged such that the positions thereof in the left-right direction (sub-scanning direction) are alternately shifted.

As illustrated in FIG. 3, each head module 61 has two nozzle rows 62. Each of the two nozzle rows 62 has multiple nozzles 63 arranged in the front-rear direction at a predetermined pitch. The positions of the nozzles 63 in the front-rear direction in one of the two nozzle rows 62 are shifted from those in the other nozzle row 62 by half the pitch.

The nozzles 63 are opened on the nozzle surface 61*a* which is a surface (lower surface) of the head module 61 facing the web W and eject the ink to the web W being conveyed.

The printer 23B prints images on a back surface of the web W. The printer 23B is arranged below the printer 23A, near and above the web W between the encoder roller 31B and the guide roller 36. The printer 23B includes head units 51K, 51C, 51M, 51Y, 51P, like the printer 23A.

The configuration of the printer 23B is right-left reversed to the configuration of the printer 23A. The configuration of the printer 23B is the same as that of the printer 23A except for being right-left reversed.

The printing apparatus controller 24 controls operations of the units in the inkjet printing apparatus 3. The printing apparatus controller 24 includes a CPU, a memory, a hard disk drive, and the like.

In a printing operation, the printing apparatus controller 24 prints images on the web W by causing the inks to be ejected from the inkjet heads 56 of the printers 23A, 23B while conveying the web W by driving the conveyance rollers 42.

In the printing operation, the printing apparatus controller 24 controls an ink ejection timing in each of the inkjet heads 56 of the printer 23A based on an output pulse signal of the encoder 22A. Moreover, the printing apparatus controller 24 controls an ink ejection timing in each of the inkjet heads 56 of the printer 23B based on an output pulse signal of the encoder 22B.

Furthermore, the printing apparatus controller 24 controls the printing operation such that the ink ejection timing of each inkjet head 56 based on the output pulse signal of the corresponding encoder 22 is corrected based on off-center information of the corresponding encoder roller 31 calculated in advance in off-center information obtaining processing.

In the off-center information obtaining processing, the printing apparatus controller 24 causes the inkjet head 56 to print a test pattern for obtaining the off-center information which includes multiple dots arranged in the conveyance direction (sub-scanning direction) of the web W. Then, the printing apparatus controller 24 calculates the off-center information of the encoder roller 31 based on the positions of dots in the printed test pattern. The off-center information obtaining processing is described in detail later.

The rewinder 4 rewinds the web W subjected to printing in the inkjet printing apparatus 3. The rewinder 4 includes a rewinding shaft 71, a rewinding motor 72, and a rewinder controller 73.

The rewinding shaft 71 rewinds and holds the web W.

The rewinding motor 72 rotates the rewinding shaft 71 clockwise in FIG. 1. Rotation of the rewinding shaft 71 causes the web W to be rewound on the rewinding shaft 71.

The rewinder controller 73 controls drive of the rewinding motor 72. The rewinder controller 73 includes a CPU, a memory, a hard disk drive, and the like.

Next, the off-center information obtaining processing in the print system 1 is described.

The off-center information obtaining processing is processing of obtaining the off-center information which is used for correction of the ink ejection timings, the correction performed to reduce ink landing position deviation caused by off-centering of the encoder roller 31.

An off-center amount z and an off-center phase θ with respect to the Z-phase are calculated as the off-center information. The off-center amount z is the distance between the center of the encoder roller 31 and the rotation center of the encoder roller 31 (see FIG. 11). The off-center phase θ with respect to the Z-phase is an angle of rotation of the encoder roller 31 from a reference state, at a timing at which the encoder 22 outputs the Z-phase signal (see FIG. 12).

The off-center information obtaining processing is performed in a manufacturing step before product shipping of the inkjet printing apparatus 3 and in replacement of the encoder 22 or the encoder roller 31.

Figure 5:
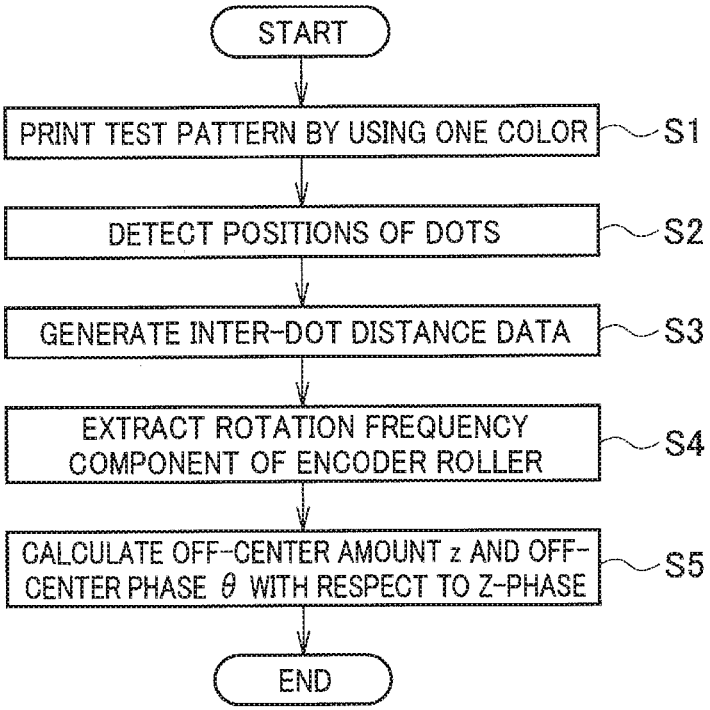
FIG. 5 is a flowchart of off-center information obtaining processing in the first embodiment.

FIG. 5 is a flowchart of the off-center information obtaining processing in the first embodiment. The off-center information obtaining processing is performed for each of the encoder rollers 31A, 31B. Here, description is given of the processing of obtaining the off-center information for the encoder roller 31A.

In step S1 of FIG. 5, the printing apparatus controller 24 causes the printer 23A to print the test pattern for obtaining the off-center information by using one color.

In the printing of the test pattern, the printing apparatus controller 24 first starts the conveyance of the web W. In order to start the conveyance of the web W, the printing apparatus controller 24 causes the conveyance motor 43 to start the drive of the conveyance rollers 42 and also instructs the unwinder controller 13 and the rewinder controller 73 to start the conveyance of the web W. When the start of the conveyance of the web W is instructed, the unwinder controller 13 causes the brake 12 to start output of brake force and the rewinder controller 73 causes the rewinding motor 72 to start drive of the rewinding shaft 71.

Unwinding and conveyance of the web W from the web roll 16 is thereby started. Applying brake to the web roll support shaft 11 with the brake 12 causes the web W to be conveyed with tension applied to the web W between the web roll 16 and the pair of conveyance rollers 42. When the conveyance of the web W is started, the output of the pulse signal from the encoder 22 is started in response to the start of the rotation of the encoder roller 31.

When the conveyance of the web W is started and then the conveyance speed of the web W is increased to a predetermined print conveyance speed V, the printing apparatus controller 24 performs conveyance control of transition to constant speed conveyance at the print conveyance speed V.

After the constant speed conveyance of the web W at the print conveyance speed V is started, the printing apparatus controller 24 causes one of the inkjet heads 56 of the printer 23A to print the test pattern for obtaining the off-center information on the web W. In this example, the inkjet head 56K prints the test pattern.

Specifically, the printing apparatus controller 24 causes the ink to be ejected from the multiple nozzles 63 at the same position in the sub-scanning direction (left-right direction) in the inkjet head 56K of the printing 23A, at a timing at which the Z-phase signal outputted from the encoder 22A is detected. The ink ejection triggered by the Z-phase signal is the first ink ejection in the printing of the test pattern. Moreover, the printing apparatus controller 24 starts count of output pulses (pulses of the A-phase signal or the B-phase signal) of the encoder 22A, from a timing at which the first ink ejection triggered by the Z-phase signal is performed.

Thereafter, the printing apparatus controller 24 causes the ink to be ejected from the nozzles 63 having performed the aforementioned first ink ejection at a timing of every predetermined ejection pulse number dP, based on the output pulse signal (A-phase signal or B-phase signal) of the encoder 22A. Specifically, the printing apparatus controller 24 causes the ink to be ejected from the nozzles 63 having performed the aforementioned first ink ejection, every time a pulse count value n which is the count value of the output pulses of the encoder 22A increases by the ejection pulse number dP.

Figure 6:
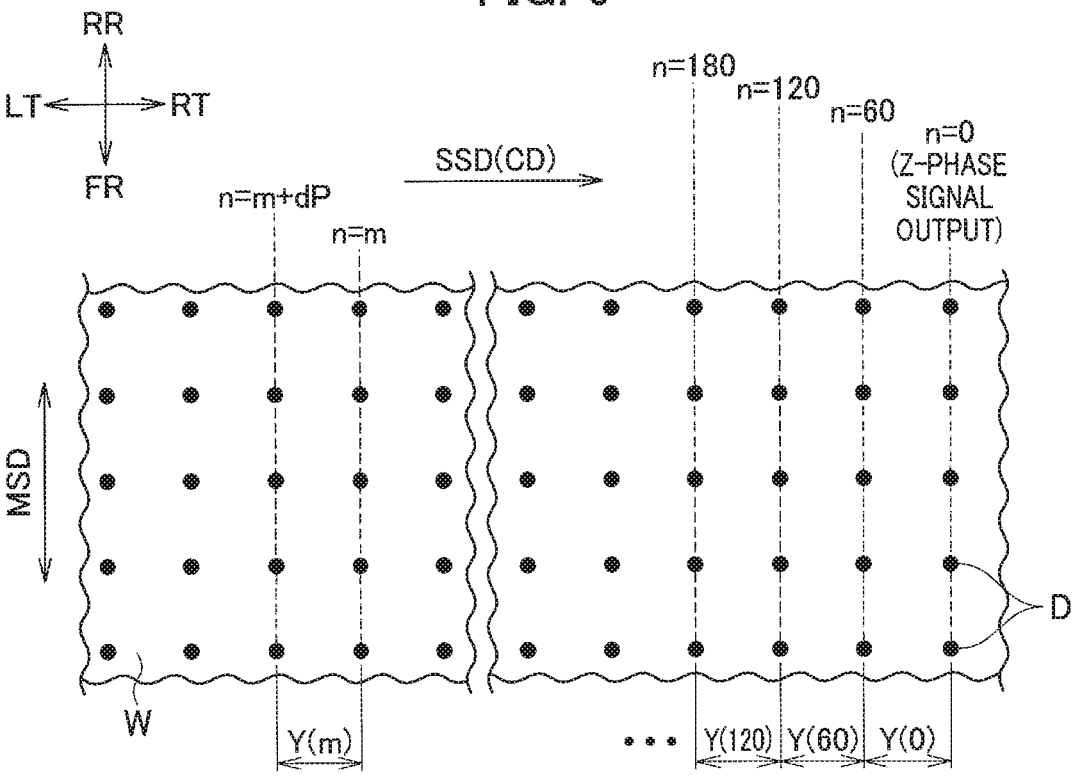
FIG. 6 is a view illustrating a test pattern in the first embodiment.

The test pattern including multiple dots D arranged in the main scanning direction and the sub-scanning direction as illustrated in FIG. 6 is thereby printed on the web W. When the ink ejection is performed a predetermined number of times at the aforementioned timings, the printing of the test pattern is completed. When the printing of the test pattern is completed, the printing apparatus controller 24 terminates the conveyance of the web W.

Returning to FIG. 5, in step S2, the printing apparatus controller 24 detects the positions of the dots D in the test pattern printed on the web W.

In this case, the print image of the test pattern is read by a not-illustrated image reading apparatus and read image data is generated. The image reading apparatus may be an apparatus provided outside the inkjet printing apparatus 3 or may be provided in the inkjet printing apparatus 3.

The printing apparatus controller 24 obtains the read image data of the test pattern from the image reading apparatus. Then, the printing apparatus controller 24 detects the positions of the respective dots D based on the read image data.

Figure 7:
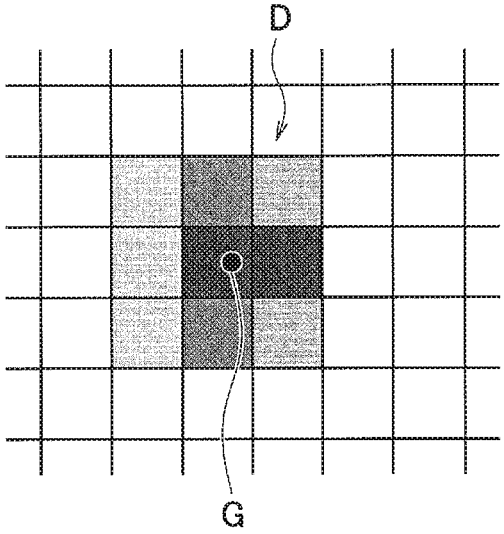
FIG. 7 is an explanatory view of detecting positions of dots in the printed test pattern.

Specifically, as illustrated in FIG. 7, the printing apparatus controller 24 calculates the densities of the respective pixels forming each dot D in the read image data. In this case, squares in FIG. 7 indicate the pixels in the read image data. Then, the printing apparatus controller 24 calculates the coordinates of the centroid G of the dot D as the position of the dot D, based on the calculated densities of the respective pixels. Calculating the position of the dot D as described above enables the accuracy of the detection of the dot position to be high for the reading resolution of the image reading apparatus.

Returning to FIG. 5, in step S3, the printing apparatus controller 24 generates inter-dot distance data based on the positions of the respective dots D detected in step S2. The inter-dot distance data is data indicating inter-dot distance Y(m) which is a distance between the dots D adjacent to each other in the sub-scanning direction. As illustrated in FIG. 6, the inter-dot distance Y(m) is a distance between the dots D of the ink ejected at an ejection timing of count value n=m and the dots D of the ink ejected at the next ejection timing (n=m+dP).

Specifically, the printing apparatus controller 24 calculates each inter-dot distance Y(m) based on the positions of the dots D in the sub-scanning direction detected in step S2. In this case, the calculation may be performed such that an average of the positions, in the sub-scanning direction, of the multiple dots aligned in the main scanning direction is calculated and thus-obtained averages are used as the positions of the dots D in the sub-scanning direction. Alternatively, the positions, in the sub-scanning direction, of the dots D formed by using the ink ejected from any one of the nozzles 63 may be used to calculate the inter-dot distance Y(m).

Figure 8:
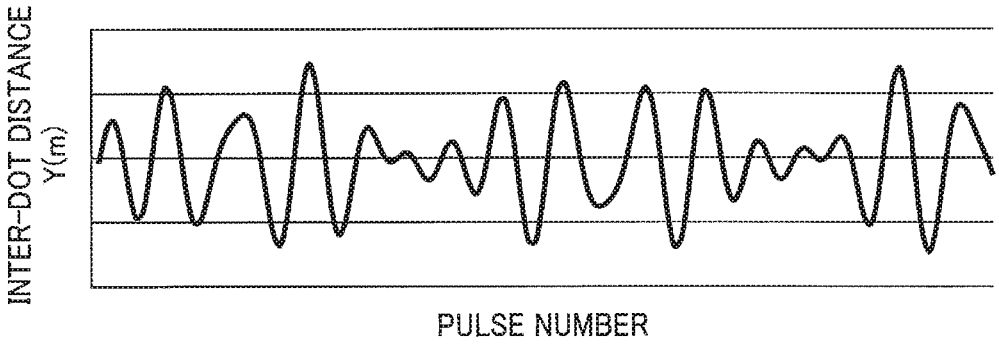
FIG. 8 is a view illustrating an example of inter-dot distance data.

Then, as illustrated in FIG. 8, the printing apparatus controller 24 generates data indicating the inter-dot distances Y(m) as the inter-dot distance data.

The inter-dot distance Y(m) is constant in an ideal condition. However, as illustrated in FIG. 8, the inter-dot distance Y(m) actually fluctuates. One of factors which cause fluctuation of the inter-dot distance Y(m) is off-centering of the encoder roller 31A. Moreover, the inter-dot distance data includes fluctuation of the inter-dot distance Y(m) caused by other factors such as off-centering of the rollers other than the encoder roller 31A and sliding of the web W on the rollers.

Thus, in the off-center information obtaining processing, in step S4 of FIG. 5, the printing apparatus controller 24 extracts a rotation frequency component of the encoder roller 31A from the inter-dot distance data to obtain the off-center information of the encoder roller 31A.

Figure 9:
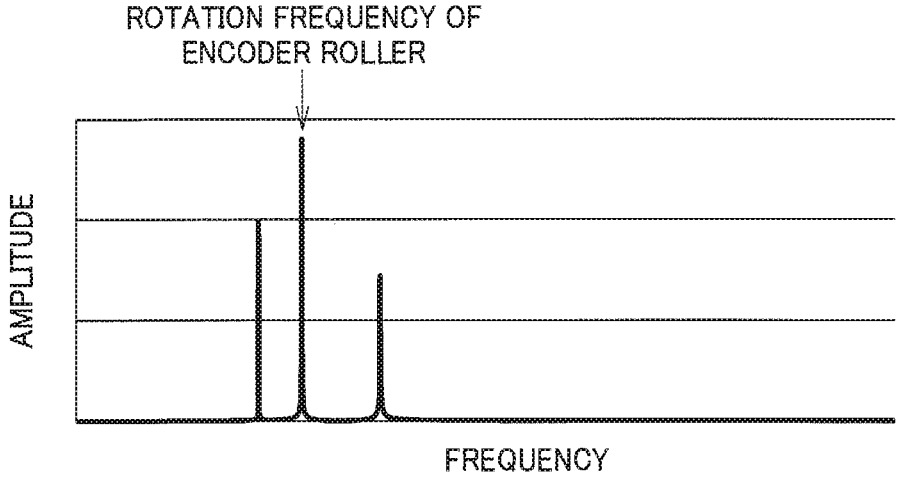
FIG. 9 is a view illustrating an example of a result of Fourier transformation performed on the inter-dot distance data.
Figure 10:
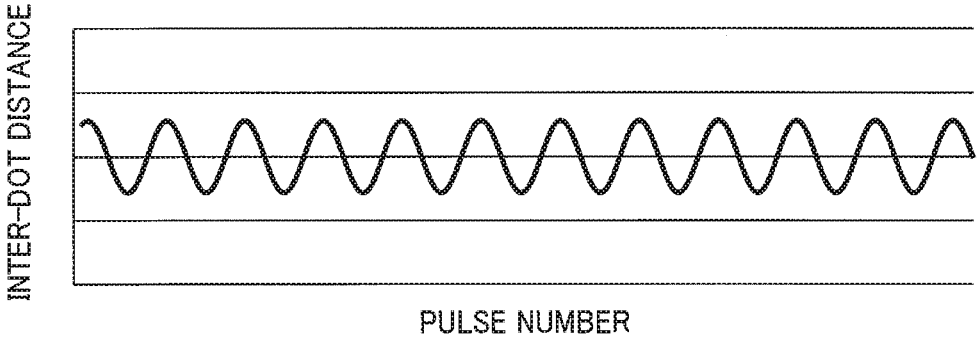
FIG. 10 is a view illustrating an example of a rotation frequency component of an encoder roller extracted from the inter-dot distance data.

Specifically, first, the printing apparatus controller 24 performs Fourier transformation on the inter-dot distance data. The result as illustrated in FIG. 9 is thereby obtained. Next, the printing apparatus controller 24 deletes frequencies other than the rotation frequency of the encoder roller 31A from the result of the Fourier transformation. Then, the printing apparatus controller 24 performs inverse Fourier transformation on the data from which the frequencies other than the rotation frequency of the encoder roller 31A are deleted. A rotation frequency component of the encoder roller 31A as illustrated in FIG. 10 is thereby obtained.

Note that the rotation frequency component of the encoder roller 31A may be extracted from the inter-dot distance data by using a band pass filter.

The rotation frequency of the encoder roller 31A is obtained from the conveyance speed (print conveyance speed V) of the web W and the outer diameter of the encoder roller 31A. As described above, since the encoder roller 31A has an outer diameter different from those of all other rollers, the encoder roller 31A has a rotation frequency different from those of all other rollers. Accordingly, it is possible to extract only the rotation frequency component of the encoder roller 31A from the inter-dot distance data.

Returning to FIG. 5, in step S5, the printing apparatus controller 24 calculates the off-center amount z and the off-center phase θ with respect to the Z-phase of the encoder roller 31A based on the rotation frequency component of the encoder roller 31A extracted in step S4.

In order to calculate the off-center amount z and the off-center phase θ with respect to the Z-phase, there is used a theoretical formula expressing the inter-dot distance Y(m) in the case where the off-centering of one encoder roller 31 is the only factor causing the fluctuation of the inter-dot distance Y(m).

The theoretical formula expressing the inter-dot distance Y(m) is described.

Figure 11:
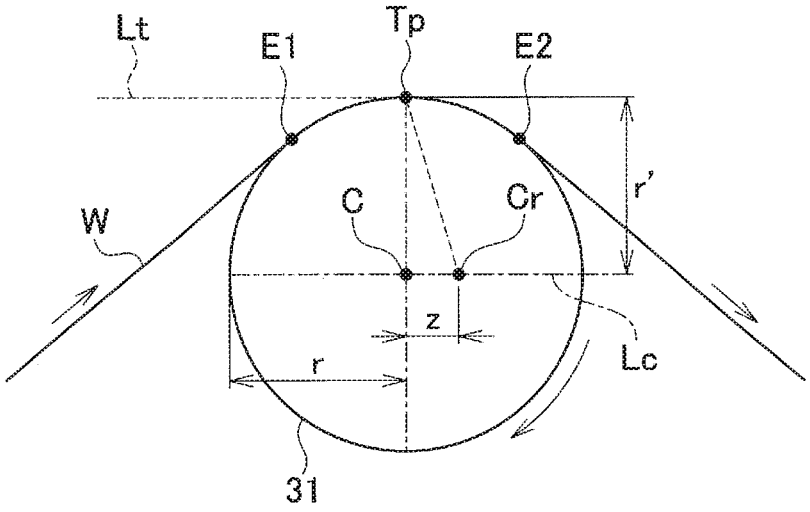
FIG. 11 is an explanatory view of a reference state of the encoder roller.

As illustrated in FIG. 11, a state where a tangent Lt is parallel to a center line Lc passing the center C of the encoder roller 31 and the rotation center Cr of the encoder roller 31 is referred to as a reference state of the encoder roller 31, the tangent Lt being a tangent at a top point Tp of an arc portion of the encoder roller 31 where the web W is wound. In FIG. 11, an arc portion between a point E1 and a point E2 is the arc portion of the encoder roller 31 where the web W is wound.

Moreover, the radius of the encoder roller 31 is denoted by r and an effective radius of the encoder roller 31 is denoted by r'. The effective radius r' is a distance between the top point Tp and the rotation center Cr in the direction orthogonal to the tangent Lt. In the reference state illustrated in FIG. 11, the radius r of the encoder roller 31 is equal to the effective radius r'.

Figure 12:
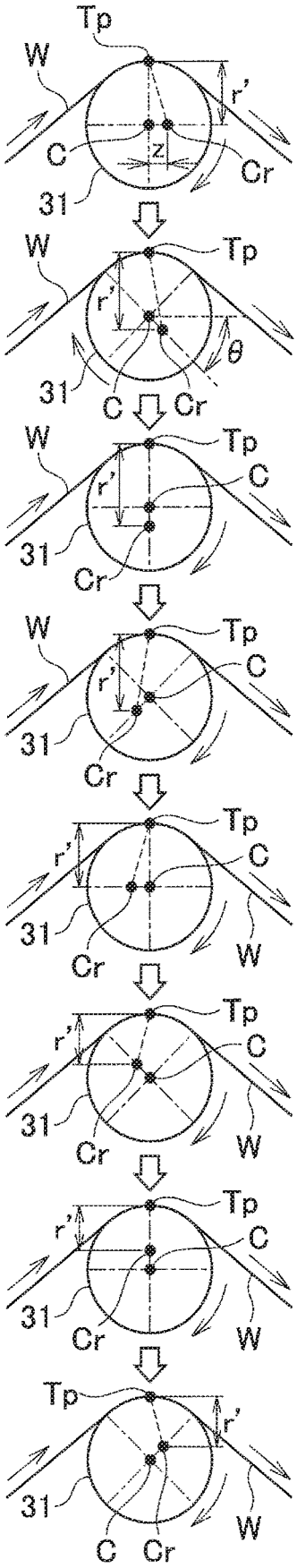
FIG. 12 is a view illustrating states of rotation of the encoder roller.

In the conveyance of the web W, the encoder roller 31 rotates about the rotation center Cr as illustrated in FIG. 12. FIG. 12 illustrates states of the rotation of the encoder roller 31 at intervals of rotation of 45 degrees. The encoder roller 31 illustrated in the top section of FIG. 12 is in the reference state as in FIG. 11. As illustrated in FIG. 12, when the encoder 22 outputs the Z-phase signal at the timing of the state illustrated in the second section from the top, the rotation angle of the encoder roller 31 from the reference state in the top section to the state in the second section from the top is the off-center phase θ with respect to the Z-phase. In this case, off-center phase θ with respect to the Z-phase=45 degrees (=n/4[rad]).

The effective radius r' (n) of the encoder roller 31 rotating in the printing of the test pattern of FIG. 6, at the timing of the pulse count value n is expressed by the following formula (1).

(Math 1)

$$r'(n) = r + z\,\sin\left(\frac{2\pi}{P}n + \theta\right) \tag{1}$$

In this formula, P is the number of output pulses of the encoder 22 in one rotation of the encoder roller 31.

The inter-dot distance Y(m) is expressed by the following formula (2) as a distance over which the web W is actually conveyed between successive ink ejection timings.

(Math 2)

$$Y(m) = \int_m^{m+dP} \frac{2\pi r'(n)}{P}\,dn \tag{2}$$

The following formula (3) is obtained from the formulae (1) and (2).

(Math 3)

$$Y(m) = \frac{2\pi r}{P} - z\left[\cos\left(\frac{2\pi}{P}n + \theta\right)\right]_m^{m+dP} \tag{3}$$

The following formula (4) is obtained by solving and transforming the formula (3).

(Math 4)

$$Y(m) = 2z\,\sin\left(\frac{\pi dP}{P}\right)\sin\left(\frac{\pi dP}{P} + \frac{2\pi m}{P} + \theta\right) + \frac{2\pi r}{P} \tag{4}$$

The aforementioned formula (4) is the theoretical formula expressing the inter-dot distance Y(m).

The amplitude and the phase of the rotation frequency component of the encoder roller 31A are obtained from the data of the rotation frequency component of the encoder roller 31A extracted in step S4 of FIG. 5 described above.

"2z sin(πdP/P)" in the formula (4) corresponds to the amplitude and "πdP/P+2 πm/P+θ" of sin(πdP/P+2 πm/P+θ) in the formula (4) corresponds to the phase.

Thus, in step S5 of FIG. 5, the printing apparatus controller 24 compares the amplitude in the formula (4) with the amplitude of the rotation frequency component of the encoder roller 31A extracted in step S4 to calculate the off-center amount z of the encoder roller 31A. Moreover, the printing apparatus controller 24 compares the phase in the formula (4) with the phase of the rotation frequency component of the encoder roller 31A extracted in step S4 to calculate the off-center phase θ with respect to the Z-phase of the encoder roller 31A.

After calculating the off-center amount z and the off-center phase θ with respect to the Z-phase, the printing apparatus controller 24 stores values of the off-center amount z and the off-center phase θ with respect to the Z-phase and terminates the off-center information obtaining processing.

In the above description of the off-center information obtaining processing, the processing of obtaining the off-center information of the encoder roller 31A is described. The printing apparatus controller 24 also performs similar off-center information obtaining processing for the encoder roller 31B.

Next, a printing operation of the print system 1 is described.

In the printing, the printing apparatus controller 24 conveys the web W at the print conveyance speed V. Then, the printing apparatus controller 24 prints images on the web W by causing the inks to be ejected from the nozzles 63 of the inkjet heads 56 in the printers 23A, 23B based on a print job.

In this case, the printing apparatus controller 24 controls the ink ejection timings in the inkjet heads 56 of the printer 23A based on the output pulse signal of the encoder 22A. Moreover, the printing apparatus controller 24 controls the ink ejection timings in the inkjet heads 56 of the printer 23B based on the output pulse signal of the encoder 22B.

In this case, the printing apparatus controller 24 performs control such that the ink ejection timing of each inkjet head 56 based on the output pulse signal of the corresponding encoder 22 is corrected based on the off-center information (off-center amount z and off-center phase θ with respect to the Z-phase) of the corresponding encoder roller 31.

Specifically, for each of the pulses in the output pulse signal of the encoder 22, the printing apparatus controller 24 calculates the value of the formula (4) in which dp in "$2z \sin(\pi dP/P) \sin(\pi dP/P+2\pi m/P+\theta)$" being the first term in the formula (4) is set to 1 and m in this term is replaced by the number of pulses from the output timing of the Z-phase signal to this pulse, by using the off-center information (off-center amount z and off-center phase θ with respect to the Z-phase). This value indicates the deviation amount in the conveyance amount of the web W in this pulse, caused by the off-centering of the encoder roller 31. The printing apparatus controller 24 corrects the pulse width depending on the calculated deviation amount in the conveyance amount of the web W and thereby corrects the ink ejection timing. The ink landing position deviation is thereby reduced.

When the printing based on the print job is completed, the printing apparatus controller 24 terminates the conveyance of the web W. The printing operation is thereby completed.

As described above, in the inkjet printing apparatus 3, the printing apparatus controller 24 causes the inkjet head 56 to print the test pattern for obtaining the off-center information on the web W in the off-center information obtaining processing. Moreover, the printing apparatus controller 24 calculates the off-center information of the encoder roller 31 based on the positions of the dots D in the printed test pattern. Then, the printing apparatus controller 24 controls the printing operation such that the ink ejection timings of the inkjet heads 56 based on the output pulse signal of the encoder 22 is corrected based on the off-center information of the encoder roller 31.

It is possible to correct the ink ejection timing and reduce the landing position deviation caused by the off-centering of the encoder roller 31 by measuring the movement speed of the web W with a measurement unit and using the result of this measurement for the correction unlike in the embodiment. However, in this method, a large measurement unit such as a laser Doppler velocimeter needs to be used to measure the speed of the web W. Meanwhile, in the inkjet printing apparatus 3 of the embodiment, there is no need to use a large measurement unit. Accordingly, the ink landing position deviation can be easily reduced.

Moreover, there is no need to unitize the encoder roller 31 and the encoder 22 and obtain the off-center information in advance, and the off-center information of the encoder roller 31 can be obtained in the inkjet printing apparatus 3 when the encoder roller 31 or the encoder 22 is replaced. Accordingly, it is possible to reduce waste caused by replacement of a part requiring no replacement such as the encoder roller 31 or the encoder 22 which occurs when the encoder roller 31 and the encoder 22 are unitized.

Thus, the inkjet printing apparatus 3 can easily reduce the ink landing position deviation while reducing the wasting of parts.

Moreover, in the inkjet printing apparatus 3, each of the encoder rollers 31A, 31B have an outer diameter different from those of all other rollers. In the off-center information obtaining processing, the printing apparatus controller 24 extracts the rotation frequency component of each of the encoder rollers 31A, 31B from the inter-dot distance data and calculates the off-center information based on the extracted rotation frequency component. The printing apparatus controller 24 can thereby remove the factors other than the off-centering of the encoder roller 31A, 31B such as the off-centering of the rollers other than the encoder roller 31A, 31B from the inter-dot distance data and calculate the off-center information of the encoder roller 31A, 31B with high accuracy.

Next, description is given of a second embodiment in which the off-center information obtaining processing in the first embodiment is changed.

In the second embodiment, in the off-center information obtaining processing, the printing apparatus controller 24 causes each of the printers 23A, 23B to print test patterns for obtaining the off-center information on the web W by using two inkjet heads 56. Then, the printing apparatus controller 24 calculates the off-center information based on positional relationships of dots between the test patterns printed by the two inkjet heads.

The off-center information obtaining processing in the second embodiment is described with reference to the flowchart of FIG. 13. As in the first embodiment, the off-center information obtaining processing is performed for each of the encoder rollers 31A, 31B. Here, description is given of the processing of obtaining the off-center information for the encoder roller 31A.

Figure 13:
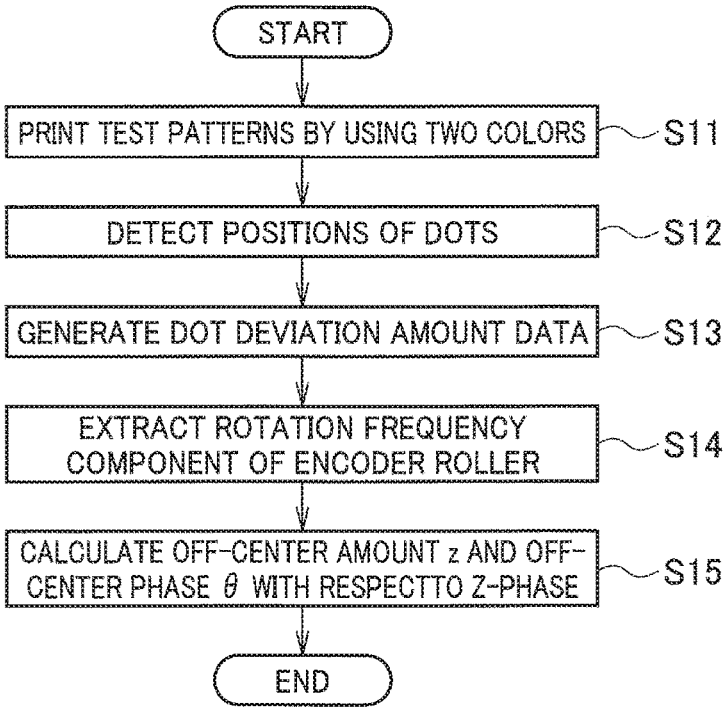
FIG. 13 is a flowchart of off-center information obtaining processing in a second embodiment.

In step S11 of FIG. 13, the printing apparatus controller 24 causes the two inkjet heads 56 in the printer 23A to print the test patterns for obtaining the off-center information by using two colors.

In the printing of the test pattern, the printing apparatus controller 24 conveys the web W at the print conveyance speed V. Then, the printing apparatus controller 24 causes the two inkjet heads 56 in the printer 23A to print the test patterns for obtaining the off-center information on the web W. In this example, the inkjet heads 56K, 56C print the test patterns.

Specifically, the printing apparatus controller 24 causes the ink to be ejected from the multiple nozzles 63 at the same position in the sub-scanning direction in the inkjet head 56K of the printing 23A, at a timing at which the Z-phase signal outputted from the encoder 22A is detected. The ink ejection triggered by the Z-phase signal is the first ink ejection by the inkjet head 56K in the printing of the test pattern. Moreover, the printing apparatus controller 24 starts the count of the output pulses of the encoder 22A, from the timing when the first ink ejection of the inkjet head 56K triggered by the Z-phase signal is performed.

Thereafter, the printing apparatus controller 24 causes the ink to be ejected from the nozzles 63 having performed the aforementioned first ink ejection in the inkjet head 56K at the timing of every predetermined ejection pulse number dP, based on the output pulse signal of the encoder 22A.

Moreover, the printing apparatus controller 24 causes the ink to be ejected from the multiple nozzles 63 at the same position in the sub-scanning direction in the inkjet head 56C at a timing when pulse count value n=PL/πR is satisfied. The ink ejection at the timing of n=PL/πR is the first ink ejection by the inkjet head 56C in the printing of the test pattern. In this case, the printing apparatus controller 24 sets the nozzles 63 from which the ink is to be ejected in the inkjet head 56C, to the nozzles 63 at different positions in the main scanning direction from the nozzles 63 having ejected the ink in the inkjet head 56K. Here, L is a distance between the adjacent inkjet heads 56 in the printer 23 on the conveyance route. R is the outer diameter of the encoder roller 31.

Thereafter, the printing apparatus controller 24 causes the ink to be ejected from the nozzles 63 having performed the aforementioned first ink ejection in the inkjet head 56C at the timing of every ejection pulse number dP, based on the output pulse signal of the encoder 22A. The ink ejection in the inkjet head 56C is thereby performed at a timing (PL/πR) pulses after each ejection timing in the inkjet head 56K.

The ejection timing in the inkjet head 56C is set as described above to make the black ink and the cyan ink land at the same position in the sub-scanning direction in an ideal condition.

Figure 14:
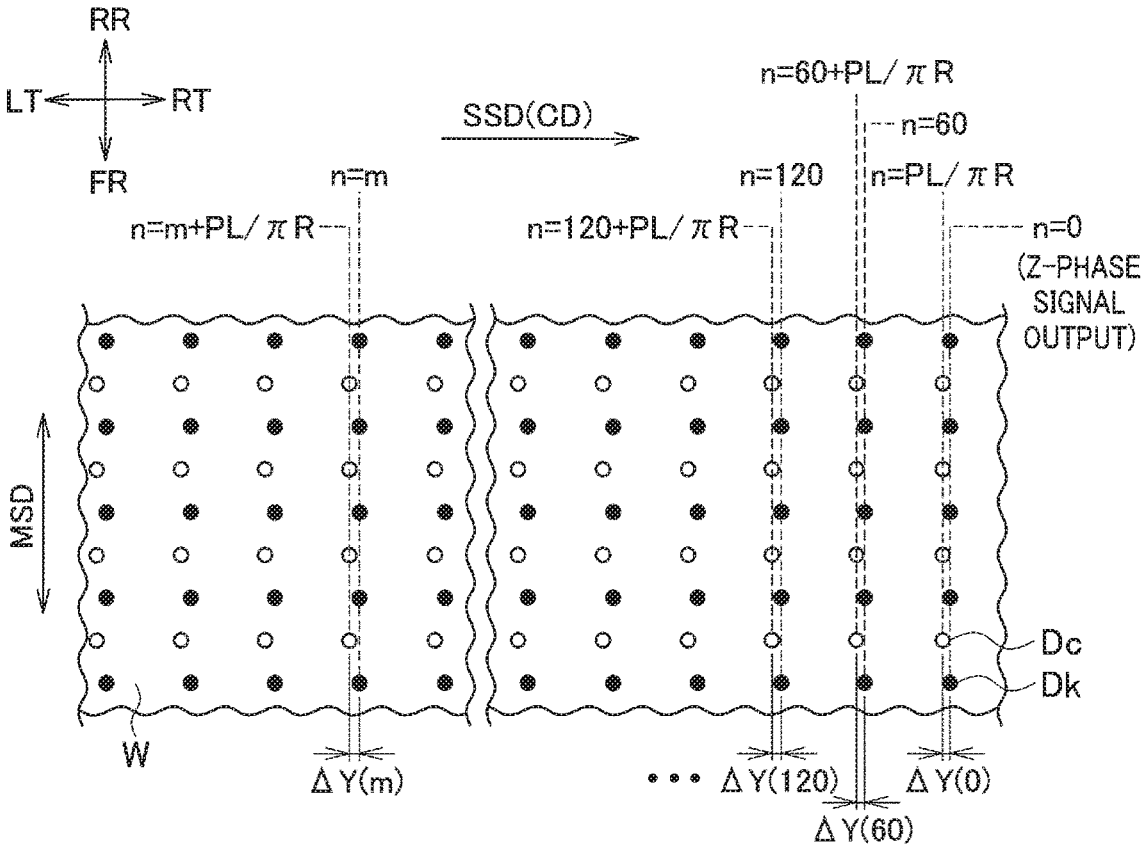
FIG. 14 is a view illustrating test patterns in the second embodiment.

As illustrated in FIG. 14, ejecting the inks from the inkjet heads 56K, 56C as described above causes the test pattern including multiple black dots Dk and the test pattern including multiple cyan dots Dc to be printed on the web W. The dots Dk, Dc are arranged in the main scanning direction and the sub-scanning direction. When the ink ejection is performed a predetermined number of times at the aforementioned timings in each of the inkjet heads 56K, 56C, the printing of the test pattern is completed. When the printing of the test pattern is completed, the printing apparatus controller 24 terminates the conveyance of the web W.

Returning to FIG. 13, in step S12, the printing apparatus controller 24 detects the positions of the dots Dk, Dc in the test patterns printed on the web W. The detection of the positions of the dots Dk, Dc is performed by the same processing as the detection of the positions of the dots D described in the first embodiment.

Next, in step S13, the printing apparatus controller 24 generates dot deviation amount data (positional relationship data) based on the positions of the respective dots D detected in step S12. The dot deviation amount data is data of a dot deviation amount ΔY(m) indicating the positional relationships between the dots Dk, Dc corresponding to each other and formed in the test patterns printed respectively by the inkjet heads 56K, 56C.

As illustrated in FIG. 14, the dot deviation amount ΔY(m) is a distance in the sub-scanning direction between the dots Dk formed by using the black ink ejected at the ejection timing of pulse count value n=m and the cyan dots Dc corresponding to these black dots Dk. Here, the dots Dc corresponding to the dots Dk are formed by using the cyan ink ejected at a timing (PL/πR) pulses after the ejection timing of the black ink used to form the dots Dk.

Specifically, the printing apparatus controller 24 calculates each dot deviation amount ΔY(m) based on the positions of the dots Dk, Dc in the sub-scanning direction detected in step S12. In this case, the calculation may be performed such that an average of the positions, in the sub-scanning direction, of multiple dots Dk aligned in the main scanning direction is calculated and is used as the position of the dots Dk in the sub-scanning direction. The same applies to the dots Dc. Alternatively, the position, in the sub-scanning direction, of the dot Dk formed by using the ink ejected from any one of the nozzles 63 in the inkjet head 56K and the position, in the sub-scanning direction, of the dot Dc formed by using the ink ejected from any one of the nozzles 63 in the inkjet head 56C may be used to calculate the dot deviation amount ΔY(m).

Figure 15:
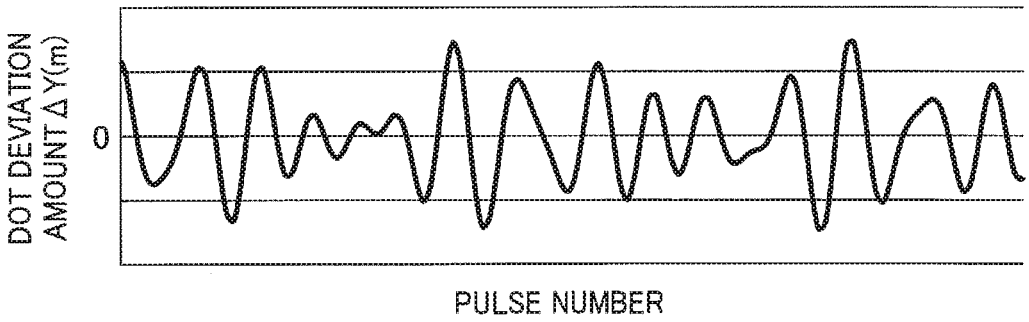
FIG. 15 is a view illustrating an example of dot deviation amount data.

Then, as illustrated in FIG. 15, the printing apparatus controller 24 generates data indicating the dot deviation amounts ΔY(m) as the dot deviation amount data.

The dot deviation amount ΔY(m) is zero in an ideal condition. This is because, as described above, in the printing of the test patterns, the ink is ejected from the inkjet head 56C at the timing (PL/πR) pulses after each ejection timing in the inkjet head 56K. However, as illustrated in FIG. 15, the dot deviation amount ΔY(m) actually fluctuates. The dot deviation amount ΔY(m) fluctuates due to the same reasons as those of the fluctuation of the inter-dot distance Y(m) used in the first embodiment.

Specifically, the dot deviation amount data includes, in addition to fluctuation of the dot deviation amount ΔY(m) caused by the off-centering of the encoder roller 31A, fluctuation of the dot deviation amount ΔY(m) caused by other factors such as off-centering of the rollers other than the encoder roller 31A.

Thus, in step S14 of FIG. 13, the printing apparatus controller 24 extracts the rotation frequency component of the encoder roller 31A from the dot deviation amount data. The extraction of the rotation frequency component of the encoder roller 31A from the dot deviation amount data is performed by the same processing as the extraction of the rotation frequency component of the encoder roller 31A from the inter-dot distance data described in the first embodiment.

Figure 16:
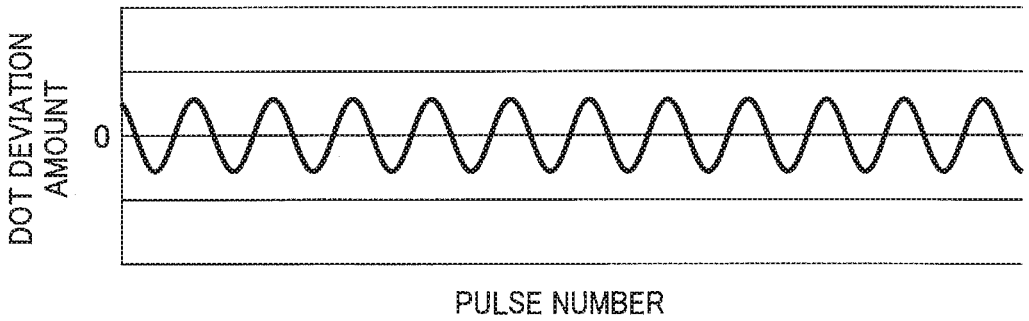
FIG. 16 is a view illustrating an example of the rotation frequency component of the encoder roller extracted from the dot deviation amount data.

Specifically, the printing apparatus controller 24 performs Fourier transformation on the dot deviation amount data and deletes frequencies other than the rotation frequency of the encoder roller 31A from the result of the Fourier transformation. Then, the printing apparatus controller 24 performs inverse Fourier transformation on the data from which the frequencies other than the rotation frequency of the encoder roller 31A are deleted. A rotation frequency component of the encoder roller 31A as illustrated in FIG. 16 is thereby obtained.

Note that the rotation frequency component of the encoder roller 31A may be extracted from the dot deviation amount data by using a band pass filter.

Returning to FIG. 13, in step S15, the printing apparatus controller 24 calculates the off-center amount z and the off-center phase θ with respect to the Z-phase of the encoder roller 31A based on the rotation frequency component of the encoder roller 31A extracted in step S14.

In order to calculate the off-center amount z and the off-center phase θ with respect to the Z-phase, there is used a theoretical formula expressing the dot deviation amount ΔY(m) in the case where the off-centering of one encoder roller 31 is the only factor causing the fluctuation of the dot deviation amount ΔY(m).

The theoretical formula expressing the dot deviation amount ΔY(m) is described.

The dot deviation amount ΔY(m) is expressed by the following formula (5) as a difference between an actual conveyance amount and an ideal conveyance amount of the web W between the two inkjet heads 56 having printed the test patterns. Here, the two inkjet heads 56 having printed the test patterns are assumed to be two inkjet heads 56 adjacent to each other like the inkjet heads 56K, 56C having printed the test patterns in the example of FIG. 14.

(Math 5)

$$\Delta Y(m) = \int_{m}^{m+PL/\pi r} \frac{2\pi}{P}(r'(n) - r)dn \tag{5}$$

The following formula (6) is obtained from the formulae (1) and (5).

(Math 6)

$$\Delta Y(m) = -z\left[\cos\left(\frac{2\pi}{P}n + \theta\right)\right]_{m}^{m+PL/\pi R} \tag{6}$$

The following formula (7) is obtained by solving and transforming the formula (6).

(Math 7)

$$\Delta Y(m) = 2z\ \sin\left(\frac{L}{R}\right)\sin\left(\frac{L}{R} + \frac{2\pi m}{P} + \theta\right) \tag{7}$$

The aforementioned formula (7) is the theoretical formula expressing the dot deviation amount ΔY(m).

When the actual conveyance amount of the web W between the two inkjet heads 56 is greater than the ideal conveyance amount, the dot deviation amount ΔY(m) calculated in the formula (7) is a positive value. In the example of FIG. 14, when the dots Dc are deviated to the left relative to the dots Dk, the dot deviation amount ΔY(m) calculated in the formula (7) is a positive value. When the dots Dc are deviated to the right relative to the dots Dk, the dot deviation amount ΔY(m) calculated in the formula (7) is a negative value.

The amplitude and the phase of the rotation frequency component of the encoder roller 31A are obtained from the data of the rotation frequency component of the encoder roller 31A extracted in step S14 of FIG. 13 described above.

"2z sin(L/R)" in the formula (7) corresponds to the amplitude and "L/R+2 πm/P+θ" of sin(L/R+2 πm/P+θ) in the formula (7) corresponds to the phase.

Thus, in step S15 of FIG. 13, the printing apparatus controller 24 compares the amplitude in the formula (7) with the amplitude of the rotation frequency component of the encoder roller 31A extracted in step S14 to calculate the off-center amount z of the encoder roller 31A. Moreover, the printing apparatus controller 24 compares the phase in the formula (7) with the phase of the rotation frequency component of the encoder roller 31A extracted in step S14 to calculate the off-center phase θ with respect to the Z-phase of the encoder roller 31A.

After calculating the off-center amount z and the off-center phase θ with respect to the Z-phase, the printing apparatus controller 24 stores values of the off-center amount z and the off-center phase θ with respect to the Z-phase and terminates the off-center information obtaining processing.

In the above description of the off-center information obtaining processing, the processing of obtaining the off-center information of the encoder roller 31A is described. The printing apparatus controller 24 also performs similar off-center information obtaining processing for the encoder roller 31B.

The point that the ink ejection timings of the inkjet heads 56 are corrected based on the off-center information (off-center amount z and off-center phase θ with respect to the Z-phase) of the encoder rollers 31 in the printing operation and the method of this correction are the same as those in the first embodiment.

As described above, in the second embodiment, the printing apparatus controller 24 causes the two inkjet heads 56 in each of the printers 23A, 23B to print the test patterns for obtaining the off-center information on the web W in the off-center information obtaining processing. Next, the printing apparatus controller 24 calculates the off-center information based on the positional relationships of the dots between the test patterns printed by the two inkjet heads 56. Then, the printing apparatus controller 24 controls the printing operation such that the ink ejection timing of each inkjet head 56 based on the output pulse signal of the corresponding encoder 22 is corrected based on the off-center information of the corresponding encoder roller 31.

Also in the second embodiment as described above, it is possible to easily reduce the ink landing position deviation while reducing the wasting of parts as in the first embodiment.

Moreover, in the second embodiment, the printing apparatus controller 24 extracts the rotation frequency component of each of the encoder rollers 31A, 31B from the dot deviation amount data in the off-center information obtaining processing and calculates the off-center information based on the extracted rotation frequency component. The printing apparatus controller 24 can thereby remove the factors other than the off-centering of the encoder roller 31A, 31B such as the off-centering of the rollers other than the encoder roller 31A, 31B from the dot deviation amount data and calculate the off-center information of the encoder roller 31A, 31B with high accuracy.

In the first and second embodiments, there is described the inkjet printing apparatus 3 which uses the long web W as the print medium and in which the encoders 22 are installed in the encoder rollers 31 which rotate by following the web W being conveyed. However, the print medium is not limited to the web and the rollers in which the encoders are installed are not limited to the rollers which rotate by following the web. The rollers in which the encoders are installed may be any rollers which rotate in synchronization with the print medium being conveyed.

For example, the present disclosure can be also applied to an inkjet printing apparatus which includes a conveyance mechanism configured to convey cut sheets used as the print medium with a conveyor belt and which controls the ink ejection timings based on an output pulse signal of an encoder installed in a roller configured to rotate by following the conveyor belt. In can be said that, also in such an inkjet printing apparatus, the roller in which the encoder is installed rotates in synchronization with the print medium being conveyed.

Moreover, in the second embodiment, the two inkjet heads 56 print the test patterns such that the dots corresponding to each other in the printed test patterns are formed at the same position in the sub-scanning direction in an ideal condition. Then, the off-center information is calculated by using the dot deviation amount which is the distance between the dots corresponding to each other in the test patterns printed by the two inkjet heads 56 in the sub-scanning direction. However, the method of calculating the off-center information is not limited to this and any method can be used as long as the off-center information is calculated based on the positional relationships of the dots between the test patterns.

Furthermore, in the second embodiment, description is given of the example in which the two inkjet heads 56 in the printer 23 corresponding to each encoder 22 print the test patterns for obtaining the off-center information. However, the test patterns may be printed by three or more inkjet heads 56. It is only necessary that the test patterns are printed by at least two of the multiple inkjet heads 56 in the printer 23. When the test patterns are printed by three or more inkjet heads 56, for example, operations as follows may be performed: the processing of calculating the off-center information based on the positional relationships of the dots between the test patterns printed by two inkjet heads 56 is performed for different pairs of the inkjet heads 56; and an average of pieces of off-center information obtained from the respective pairs is used.

The embodiments of the present disclosure have, for example, the following configurations.

An inkjet printing apparatus includes: an inkjet head configured to print an image on a print medium being conveyed by ejecting an ink to the print medium; a roller configured to rotate in synchronization with the print medium being conveyed; an encoder configured to output a pulse signal depending on a rotation angle of the roller; and a controller configured to control an ejection timing of the ink by the inkjet head in a printing operation, based on the pulse signal outputted from the encoder. The controller is configured to: perform an off-center information obtaining processing of driving the inkjet head to print a test pattern including dots arranged in a conveyance direction of the print medium and calculating an off-center information of the roller based on positions of the dots in the printed test pattern; and in the printing operation, correct the ejection timing of the ink by the inkjet head determined based on the pulse signal outputted from the encoder, based on the off-center information calculated in the off-center information obtaining processing.

The inkjet printing apparatus may further include a second roller separated from the roller and configured to rotate in synchronization with the print medium being conveyed. The encoder may be installed in the roller and the roller may have an outer diameter different from an outer diameter of the second roller. In the off-center information obtaining processing, the controller may be configured to: generate an inter-dot distance data indicating a distance between adjacent ones of the dots in the conveyance direction in the printed test pattern; extract a rotation frequency component of the roller from the generated inter-dot distance data; and calculate the off-center information based on the extracted rotation frequency component.

The inkjet printing apparatus may include a plurality of the inkjet heads. In the off-center information obtaining processing, the controller may be configured to: drive at least two of the plurality of the inkjet heads to print the test patterns; and calculate the off-center information based on positional relationships of the dots between the test patterns printed respectively by the at least two of the plurality of the inkjet heads different from each other.

The inkjet printing apparatus may further include a second roller separated from the roller and configured to rotate in synchronization with the print medium being conveyed. The encoder may be installed in the roller and the roller may have an outer diameter different from an outer diameter of the second roller. In the off-center information obtaining processing, the controller may be configured to: generate a positional relationship data indicating the positional relationships of the dots between the test patterns printed respectively by the at least two of the plurality of the inkjet heads different from each other; extract a rotation frequency component of the roller from the generated positional relationship data; and calculate the off-center information based on the extracted rotation frequency component.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printing apparatus for printing on a print medium conveyed by a plurality of rollers remaining in contact with the print medium during printing by an inkjet head, comprising:

the inkjet head, configured to print an image on the print medium being conveyed to the inkjet head by the plurality of rollers that remain in contact with the print medium during printing by the inkjet head ejecting an ink to the print medium;

an encoder roller configured to rotate in synchronization with the print medium being conveyed;

an encoder configured to output a pulse signal depending on a rotation angle of the encoder roller; and a controller configured to control an ejection timing of the ink by the inkjet head in a printing operation, based on the pulse signal outputted from the encoder, wherein the controller is configured to perform an off-center information obtaining processing of driving the inkjet head to print a test pattern including dots arranged in a conveyance direction of the print medium and calculating an off-center information of the encoder roller based on positions of the dots in the printed test pattern, wherein off-centering of any of the plurality of rollers during printing of the test pattern changes the positions of the dots in the printed test pattern, and off-centering of the encoder roller during printing of the test pattern changes the positions of the dots in the printed test pattern, and in the printing operation, correct the ejection timing of the ink by the inkjet head determined based on the pulse signal outputted from the encoder, by i) determining inter-dot distance data representing distances between adjacent dots in the test pattern, ii) determining rotation frequency components of the encoder roller and the plurality of rollers, iii) extracting the rotation frequency component of the encoder roller from the rotation frequency components of the plurality of rollers, and iv) calculating the off-center information from the extracted the rotation frequency component of the encoder roller.

2. The inkjet printing apparatus according to claim 1, wherein the plurality of rollers include a second roller separated from the encoder roller and configured to rotate in synchronization with the print medium being conveyed, wherein the encoder is installed in the encoder roller, the encoder roller has an outer diameter different from an outer diameter of the second roller, and in the off-center information obtaining processing, the controller is configured to:

extract the ft rotation frequency component of the encoder roller from the generated inter-dot distance data; and calculate the off-center information based on the extracted rotation frequency component.

3. The inkjet printing apparatus according to claim 1, comprising a plurality of the inkjet heads, wherein in the off-center information obtaining processing, the controller is configured to:

drive at least two of the plurality of the inkjet heads to print the test patterns; and calculate the off-center information based on positional relationships of the dots between the test patterns printed respectively by the at least two of the plurality of the inkjet heads, which are different from each other.

4. The inkjet printing apparatus according to claim 3, wherein the plurality of rollers include a second roller separated from the encoder roller and configured to rotate in synchronization with the print medium being conveyed, wherein the encoder is installed in the encoder roller, the encoder roller has an outer diameter different from an outer diameter of the second roller, and in the off-center information obtaining processing, the controller is configured to:

generate a positional relationship data indicating the positional relationships of the dots between the test patterns printed respectively by the at least two of the plurality of the inkjet heads which are different from each other;

extract the rotation frequency component of the encoder roller from the generated positional relationship data; and calculate the off-center information based on the extracted rotation frequency component.

5. An inkjet printing apparatus comprising:

an inkjet head configured to print an image on a print medium being conveyed by ejecting an ink to the print medium;

a roller configured to rotate in synchronization with the print medium being conveyed;

an encoder configured to output a pulse signal depending on a rotation angle of the roller; and a controller configured to control an ejection timing of the ink by the inkjet head in a printing operation, based on the pulse signal outputted from the encoder, wherein the controller is configured to perform an off-center information obtaining processing of driving the inkjet head to print a test pattern including dots arranged in a conveyance direction of the print medium and calculating an off-center information of the roller based on positions of the dots in the printed test pattern, and in the printing operation, correct the ejection timing of the ink by the inkjet head determined based on the pulse signal outputted from the encoder, based on the off-center information calculated in the off-center information obtaining processing, and wherein the controller is configured to calculate densities of respective pixels forming each of the dots in the printed test pattern and calculate coordinates of a centroid of each of the dots as the position of each of the dots based on the calculated densities of the respective pixels.

6. The inkjet printing apparatus according to claim 5, further comprising a second roller separated from the roller and configured to rotate in synchronization with the print medium being conveyed, wherein the encoder is installed in the roller, the roller has an outer diameter different from an outer diameter of the second roller, and in the off-center information obtaining processing, the controller is configured to:

generate an inter-dot distance data indicating a distance between adjacent ones of the dots in the conveyance direction in the printed test pattern;

extract a rotation frequency component of the roller from the generated inter-dot distance data; and calculate the off-center information based on the extracted rotation frequency component.

7. The inkjet printing apparatus according to claim 5, comprising a plurality of the inkjet heads, wherein in the off-center information obtaining processing, the controller is configured to:

drive at least two of the plurality of the inkjet heads to print the test patterns; and calculate the off-center information based on positional relationships of the dots between the test patterns printed respectively by the at least two of the plurality of the inkjet heads different from each other.

* * * * *